United States Patent [19]

Ikarashi et al.

[11] Patent Number: 4,987,811

[45] Date of Patent: Jan. 29, 1991

[54] ELECTRIC PUNCH

[75] Inventors: Masayoshi Ikarashi, Niigata; Kunihati Okazaki, Abiko, both of Japan

[73] Assignee: Maruzen Kabushiki Kaisha, Tokyo, Japan

[21] Appl. No.: 453,870

[22] Filed: Dec. 20, 1989

[30] Foreign Application Priority Data

Mar. 2, 1989 [JP] Japan ..... 1-50439

[51] Int. Cl.[5] ..... B26D 5/16; B26D 5/38

[52] U.S. Cl. ..... 83/372; 83/550; 83/628; 83/633; 83/687

[58] Field of Search ..... 83/684, 686, 687, 688, 83/691, 372, 550, 628, 622, 633, 555, 693; 74/50, 48

[56] References Cited

U.S. PATENT DOCUMENTS

| | | | |
|---|---|---|---|
| 2,327,646 | 8/1943 | Hutchinson | 83/550 |
| 4,079,647 | 3/1978 | Elder et al. | 83/622 |
| 4,579,029 | 4/1986 | Sunuga | 83/372 |
| 4,622,793 | 11/1986 | Oki | 74/48 |
| 4,833,958 | 5/1989 | Abildgaard et al. | 83/687 |

*Primary Examiner*—Hien H. Phan
*Assistant Examiner*—Ken Peterson
*Attorney, Agent, or Firm*—Morrison Law Firm

[57] ABSTRACT

A pair of guide bores in an electric punch support a pair of punching blocks aligned with, and movable into, respective punching holes in a main frame. Two operation arms are pivoted on respective holders and each is connected to one punching block to impart vertical motion thereto. Each operation arm includes a longitudinal guide groove therein. A pair of operation pins are driven in circular paths within the guide grooves to reciprocate the operation arms about their pivots. In the quiescent condition, the one of the guide pins lies at the end of its guide groove, whereas the other guide pin lies about in the middle of its guide groove. A guide concavity at the end of the guide grooves accepts its respective operation pin, whereby the associated operation arm rests at a different rotational position than it would if the guide concavity were omitted. A spring provides a restoring force on the punching block associated with the guide concavity. The guide grooves and holders may be positioned at selectable spacings. A reversing switch permits reversing the direction of the circular paths to clear jams.

8 Claims, 4 Drawing Sheets

ELECTRIC PUNCH

BACKGROUND OF THE INVENTION

1. Field of the Invention

The present invention relates to an electric punch, and in particular to a battery-operated portable electric punch which punches a plurality of filing holes in a sheet or sheets of paper.

2. Description of the Prior Art

Many types of electric punches are known. One conventional device has middle portions of operation arms supported by respective shafts at the side of respective holders in the manner permitting vertical rotation of the operation arms. A punching block is supported by a shaft at the end of each operation arm so that the punching blocks are vertically movable. A pair of shafts, eccentric with respect to each other, are revolvably inserted into a pair of grooves of identical shape in the rear portions of the respective operation arms.

The two punching blocks are differentially raised and lowered by revolving movement of the two eccentric shafts via their respective operation arms. The grooves in the operation arms are of identical shape, and the eccentric shafts are inserted into different regions of the grooves, causing the revolving movement of one of the operation arms to be smaller and consequently the vertical stroke of the punching block interlocked with this operation arm to be shorter. This presents a problem that the punching action may not be thorough when punching a filing hole in paper. Also, there a sheet or sheets of paper may get caught by the punching blade at the bottom of the punching block while the punching block is being raised after the punching. This can damage the paper.

SUMMARY OF THE INVENTION

It is an object of the present invention to provide a portable electric punch of a simple construction which enables the two punching blocks to be differentially raised and lowered with a large stroke and thereby to bore filing holes in paper thoroughly and smoothly as well as releasing the punched paper without causing damage from the punching blades.

It is a further object of the invention to provide an electric punch including means for reversing an electric motor to withdraw the two punching blocks in the event of stoppage of the punching operation before its completion.

It is a still further object of the invention to provide an electric punch having means for providing different actuation distances of at least two punching blocks.

It is a still further object of the invention to provide an electric punch having first and second punching blocks each driven by an operation pin engaging a guide groove in an operation arm. The actuation distance of one of the punching blocks is made longer than the other by shaping of its guide groove.

Briefly stated, the present invention provides an electric punch that includes a main body frame having two punching holes leading to a waste storage chamber below. A pair of guide bores support a pair of punching blocks aligned with, and movable into, the respective punching holes. Two operation arms are pivoted on respective holders. Each operation arm is connected to one punching block to impart vertical motion thereto. Each operation arm includes a longitudinal guide groove therein. A pair of operation pins are driven in circular paths within the guide grooves to reciprocate the operation arms about their pivots. In the quiescent condition, the one of the guide pins lies at the end of its guide groove, whereas the other guide pin lies about in the middle of its guide groove. A guide concavity at the end one of the guide grooves accepts its respective operation pin, whereby the associated operation arm rests at a different rotational position than it would if the guide concavity were omitted. A spring provides a restoring force on the punching block associated with the guide concavity. The guide grooves and holders may be positioned at selectable spacings. A reversing switch permits reversing the direction of the circular paths to clear jams.

According to an embodiment of the invention, there is provided an electric punch comprising: a base plate, at least first and second punching holes associated with the base plate, at least first and second punching blocks, means for guiding the at least first and second punching blocks vertically into the first and second punching holes, a first operation arm, first means for rotatably connecting the first operation arm to the first punching block, a first supporting shaft hingeably supporting the first operation arm, a first guide groove in the first operation arm, a first operation pin engaging the first guide groove, first rotary means for driving the first operation pin about an axis, whereby the first operation arm is rotated about the first supporting shaft, and the first punching block is moved in a vertical direction with respect to the first punching hole, a second operation arm, second means for rotatably connecting the second operation arm to the second punching block, a second supporting shaft hingeably supporting the second operation arm, a second guide groove in the second operation arm, a second operation pin engaging the second guide groove, second rotary means for driving the second operation pin about an axis, whereby the second operation arm is rotated about the second supporting shaft, and the second punching block is moved in a vertical direction with respect to the second punching hole, means for concertedly driving the first and second rotary means for driving, and the means for concertedly driving including means for disposing the first and second operation pins at rotational positions that are mutually asymmetrical, whereby strokes of the first and second punching blocks occur at staggered times.

According to a feature of the invention, there is provided an electric punch comprising: at least first and second punching holes, at least first and second punching blocks aligned for linear movement into and out of the first and second punching holes, respectively, means for concertedly driving the first and second punching blocks into the first and second punching holes, whereby holes are punched in a material, the means for concertedly driving including rotating means effective for executing a circle of motion during one cycle of operation of the first and second punching blocks, means for initiating the cycle upon an insertion of the material into the punch, means for continuing the cycle until its completion, means for reversing a direction of the driving in the event that the paper punch becomes stalled within the cycle, and means for stopping the reversing at a point in the circle of motion that permits normal forward driving to be performed in response to insertion of a material.

According to a further feature of the invention, there is provided an electric punch comprising: first and second punching blocks, first and second punching holes aligned with the first and second punching blocks, at least one rotary drive element, a first operation arm, means for connecting the first operation arm to the first punching block for generally linear displacement of the first punching block, a first guide groove in the first operation arm, first engaging means for engaging the at least one rotary drive element with the first guide groove, a second guide groove in the second operation arm, second engaging means for engaging the at least one rotary drive element with the second guide groove, the first and second engaging means including means for performing a rotation during a cycle of the electric punch, the at least one rotary drive element including means for providing asymmetrical rotational positioning of the first and second engaging means, and means for producing a longer operating stroke in the first punching block than in the second punching block.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
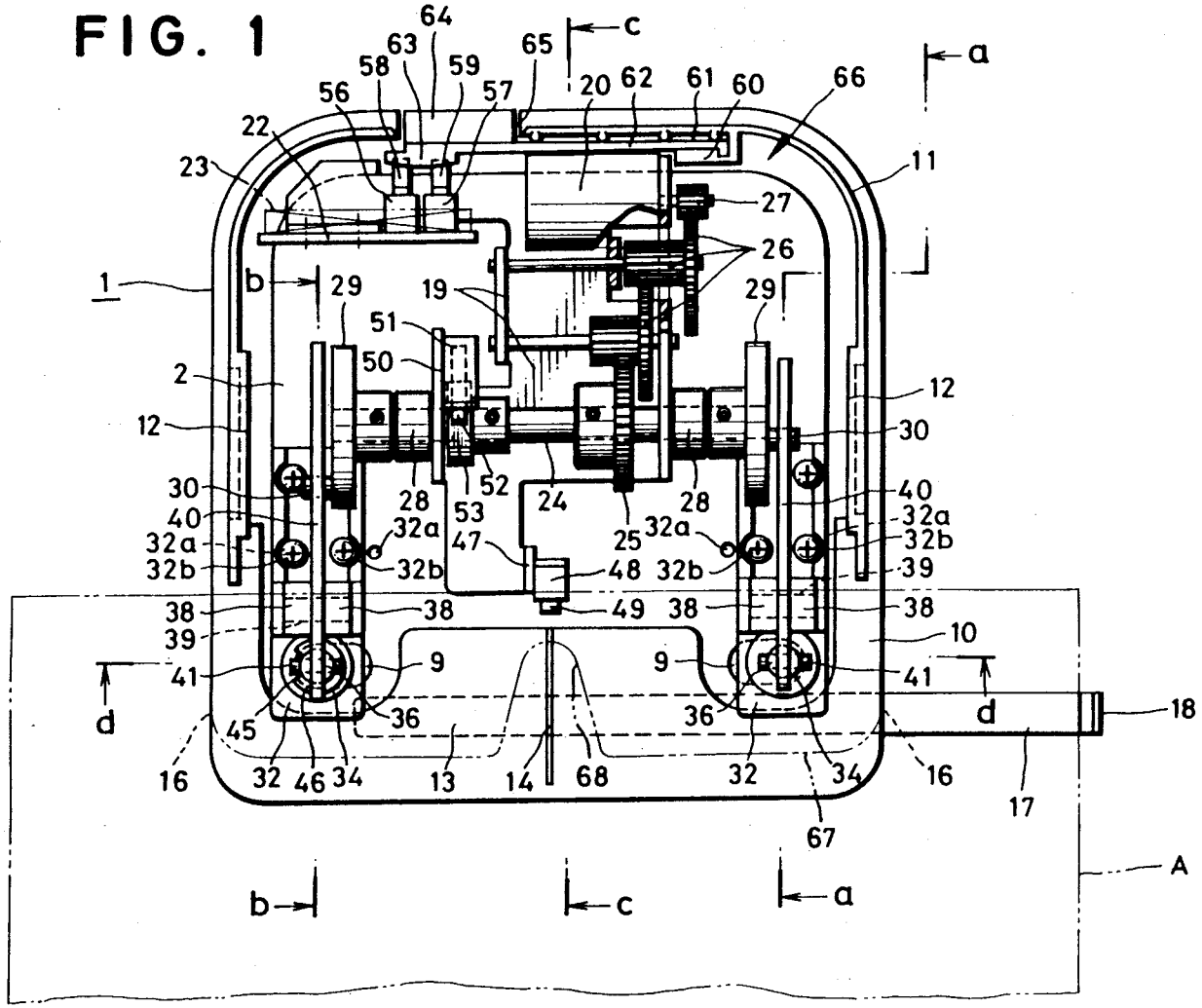
FIG. 1 is a schematic plan view of an electric punch shown its cover removed.
Figure 2:
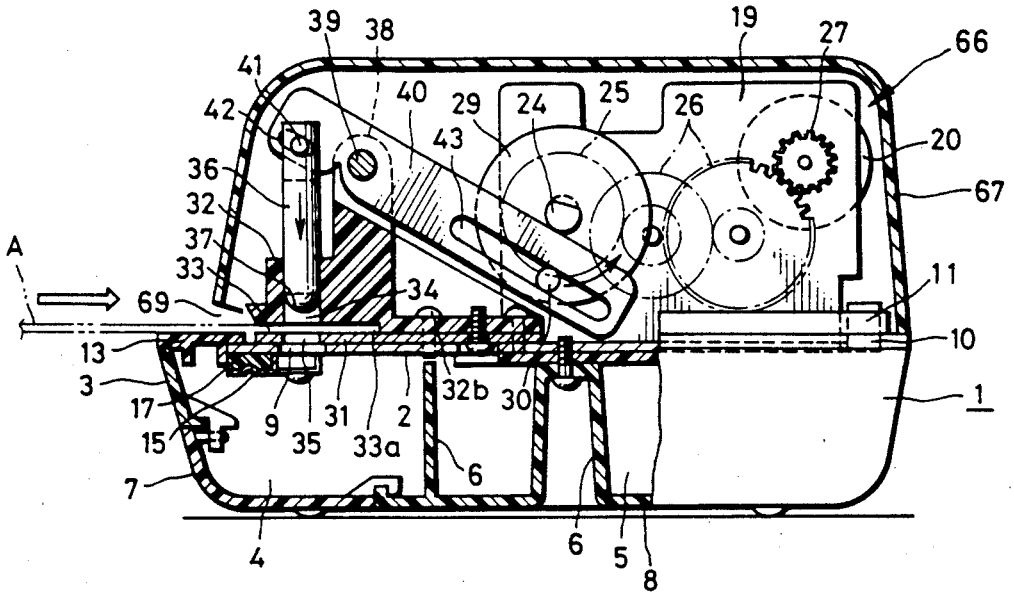
FIG. 2 is a cross section taken along the line a—a of FIG. 1.
Figure 3:
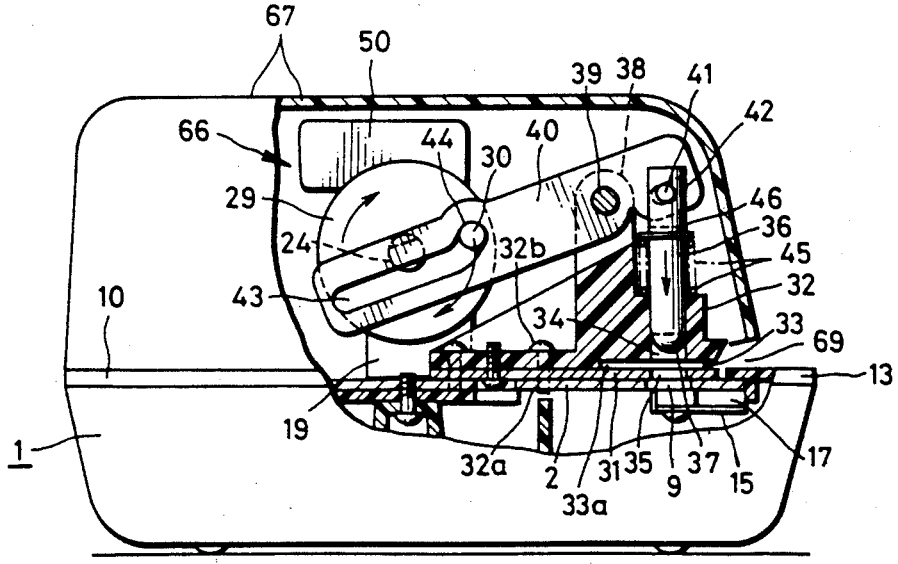
FIG. 3 is a view partly in cross section taken along the line b—b of FIG. 1.
Figure 4:
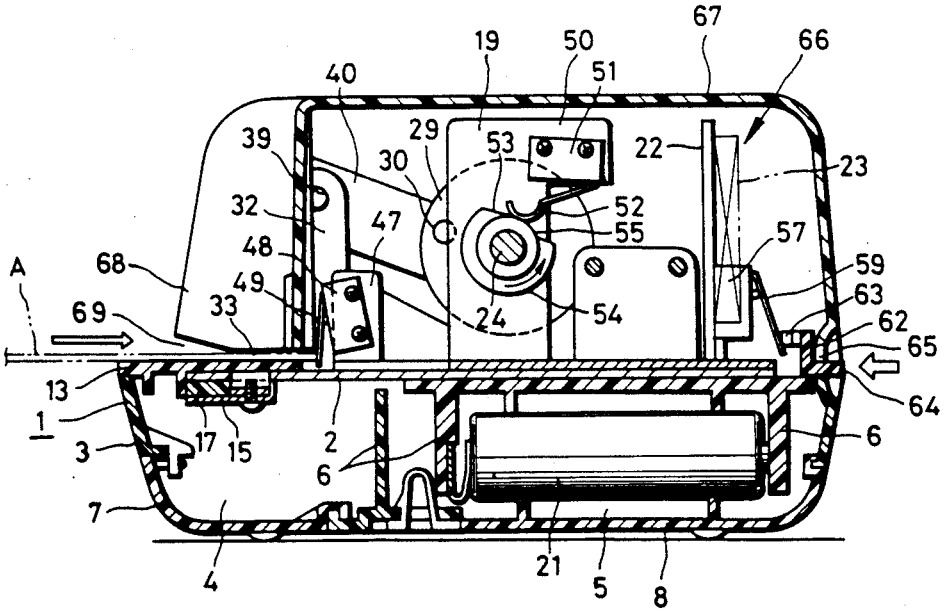
FIG. 4 is a cross section taken along the line c—c of FIG. 1.

Referring to FIGS. 1–6 a main body frame 1 comprises a base plate 2 and a casing body 3 under the base plate 2 to divide the casing body into a waste storage chamber 4 and a battery storage chamber 5, with partitions 6 between them. The waste storage chamber 4 and the battery storage chamber 5 include removable casing frames 7 and 8 respectively. A pair of sidewise-elongated guide holes 9, leading to the waste storage chamber 4, are located at the front part of the base plate 2 with a specified lateral distance between them. A side frame 10 is fixed around the base plate 2, with an integral upward-directed flange 11 at the left, right and rear ends thereof. Flange 11 is omitted from the front end of base plate 2. Stopping ledges 12 are located at the left and right sides of the flange 11. A smooth guide plate 13 is disposed at the front end of the side frame 10 to guide a sheet or sheets of paper being inserted into the apparatus. A lengthwise gauge 14 is marked at the lateral center of the guide plate 13 to indicate the center position.

A support frame 15 is laterally fixed under the base plate 2, between the guide holes 9 and the front end of the base plate 2, with its left and right sides respectively connected to a pair of guide openings 16 formed at the left and right sides of the casing body 3. A position adjusting plate 17 is inserted through the guide openings 16 and the support frame 15 in the manner that permits it to slide and still possible to be locked at a specified position. A stopper 18 extends upward at one end of the position adjusting plate 17.

A machine panel 19 is fastened to the base plate 2, from the middle part to the rear end thereof. An electric motor 20 for driving the apparatus is fixed to the upper rear part of the machine panel 19. The motor 20 is connected, through a control circuit 23 on a printed circuit board 22, to batteries 21 contained in the battery storage chamber 5. The printed circuit board 22 is affixed vertically at one of the rear corners of the base plate 2. A rotary shaft 24 is rotatably installed across the central-front part of the machine panel 19. A driving gear 25, affixed at the approximate center of rotary shaft 24, engages, through a gearing mechanism 26, a power gear 27 of the motor 20. Each gear of the gearing mechanism 26 is revolvably attached to the machine panel with a shaft. A rotary disk 29 is fitted on each end of the rotary shaft 24 in a manner that permits them to be removed or installed whenever necessary. An inner surface of each rotary disk 29 is in contact with an outer end of a spacer 28, which is removably fitted on the rotary shaft 24. An operation pin 30 extends horizontally outward from an eccentric position on each rotaty disk 29. The positions of the pins are asymmetrical with respect to each other.

A pair of holders 32 are fastened, by means of a plurality of fitting holes **32*a* and screws 32*b*, on the left-front and right-front of bases 31 between them and the base plate 2. Means are provided to permit adjustment of the lateral positions of the holders 32. The two bases 31 are supported at the same level as the upper surface of a guide plate 13 at the front part of the side frame 10. An insertion concavity 33, for inserting sheets of paper, is formed between each of the bases 31 and the front part of the bottom of its holder 32. The insertion concavities 33 are open at the front, left and right ends. A guide bore 34 and a punching hole 35 are vertically aligned in the front part of each holder 32 and base 31, respectively. Each aligned set of guide bore 34 and punching hole 35 is vertically aligned over its respective guide hole 9. A vertically slidable punching block 36 with a cylindrical shape is inserted in each of the guide bores 34. Each punching block 36 includes a punching blade 37 at its lower end. The upper part of each of the holders 32 includes a pair of supporting pieces 38 protruding upward and facing each other. A front parts of an operation arm 40 is supported by a supporting shaft 39 between each pair of the supporting pieces 38. Operation arms 40 are thus vertically rototable about their supporting shafts 39. The upper end of each punching block 36 is pivotably attached to the front end of its respective operation arms 40 with a lock pin 41 inserted through a slide hole 42. A guide groove 43 is formed in the rear portion of each operation arm 40. Each guide groove 43 is generally paralell to the length of its operation arm 40. Each guide groove 43 fits over an operation pin 30. The upper front end of one of the grooves is notched into a guide concavity 44. A coil spring 45, for applying restoring force, is attached around one of the punching blocks 36. The lower end of the coil spring 45 pushes downward against holder 32 about the upper opening of one of the guide bores 34. The upper end of coil spring 45 pushes upward against the lower surface of a washer 46** around the upper portion of the punching block.

The punching block 36 with the coil spring 45 wound around it is always urged upward by this coil spring 45 so that the punching blade 37 thereof is held above the insertion concavity 33. As a consequence, the front part of the operation arm 40 connected to this punching block 36 is also urged upward. Of the operation pins 30, the one nearer the front follows the guide concavity 44 of the guide groove 43 formed in the operation arm 40. The other operation arm 40 is rotated downward by the other operation pin 30 to a position lower than the former so that the other punching block 36 connected to this operation arm 40 is raised, with its punching blade 37 held above the insertion concavity 33. Thus, both punching blocks 36 are positioned by means of the asymmetrical operation pins 30 through their respective operation arms 40 with their punching blades 37 above the insertion concavity 33, ready for a punching operation.

A first switch 48, for starting the motor 20, is fixed to a mounting piece 47 protrudes upward near the rear end of the gauge 14 on the guide plate 13 at the center of the front end of the machine panel 19. The first switch 48 includes a switching piece 49, which is located slightly behind the center of the space between the two punching blocks 36. Contact with switching piece 49 by the edge of sheets of paper inserted in the insertion cavity 33 turns on the first switch 48. The first switch 48 energizes a control circuit 23 on the printed circuit board 22.

A second switch 51, fixed to a side plate 50 of the machine panel 19, includes a switching piece 52 facing the rotary shaft 24. The second switch is also connected to the control circuit 23 on the printed circuit board 22. A cam 53 is affixed to the rotary shaft 24, directly below the second switch 51. The cam 53 include a generally semi-circular pushing section 54 to push the switching piece 52 to completly close second switch 51 and a generally straight releasing section 55 to release the switching piece 52. The second switch 51 remains in the "off" state in the quiescent condition shown with the switching piece 52 of the second switch 51 remaining in light contact with the releasing portion 55 of the cam 53.

A third switch 56 and a fourth switch 57, are connected to drive the motor 20 in reverse through the control circuit 23. Third switch 56 and fourth switch 57 are fixed to the lower part of one side on the printed circuit board 22, with their switching pieces 58 and 59 arranged respectively behind them. A mounting piece 60 is integrally formed at, and protrudes from, the inner wall of one of the two rear portions of the flange 11 of the side frame 10. A base of an operation lever 62, made of elastic material, is fixedly fitted in a space 61 between the mounting piece 60 and the rear portion of the flange 11. A pushing section 63 of operation lever 62 includes an inner end having a pushing section 63 contacting the two switching pieces 58 and 59. An operating section 64 on the outer part of the pushing section 63 protrudes rearward therefrom through a guide opening 65 at the rear end of the flange 11. Operating section 64 is capable of moving in and out inside the guide opening 65.

The opening edge of the bottom of a cover 67, which covers a driving mechanism 66 including the whole gearing mechanism 26 stated above, is fitted around the flange 11 of the side frame 10. Catching ridges at the bottom opening of the cover 67 are fitted and locked with the stopping ledges 12 to be removable when necessary.

The cover 67 includes a concavity 68 at the lateral center of its front part to permit the gauge 14 to be visible to its inner end. The cover also forms an insertion area 69, at the front and the two sides of the bottom of the cover 67 leading to the insertion concavity 33.

In operation, a sheet or sheets of paper A are inserted deeply into the insertion area 69, between the guide plate 13 of the side frame 10 and the cover 67, and fully into the insertion concavity 33. When the front edge of the inserted paper A contacts the stopping position 33*a*, at the innermost portion of the insertion concavity 33, the switching piece 49 of the first switch 48 is pushed by the front edge of the paper A. When switching piece 49 is fully pushed, the first switch 48 is turned on, and the control circuit 23 on the printed circuit board 22 energizes the motor 20 for forward rotation. Further, with this operation of the motor 20, power gear 27, gearing mechanism 26 and drive gear 25 are interlockingly revolved in order, whereby the rotary shaft 24, to which the drive gear 25 is attached, is simultaneously rotated. With rotation of the rotary shaft 24, the cam 53 is rotated, causing the pushing section 54 next to the releasing section 55 of the cam 53 to be rotated to a position immediately below the switching piece 52 of the second switch 51. The switching piece 52 of the second switch 51 is thus pushed upward by the pushing section 54. The second switch 51 is thus turned on to maintain energization of the control circuit 23 on the printed circuit board 22. Thus the motor 20 continues to be driven for slightly less than a full revolution of the rotary shaft 24.

As the rotary shaft 24 continues to be rotated, the two rotary disks 29 are rotated, with the operation pins 30 of both rotary disks 29 revolving together. This motion of the operation pins 30 causes rotation of both operation arms 40 around their respective supporting shafts 39 and a downward stroke of each punching block 36 at the front end of their respective operation arms 40. The punching blocks 36 move down through their respective guide bores 34 toward the punching holes 35 and the guide holes 9. Filing holes are punched out in the punching areas of the paper A by the punching blades 37 at the bottom of the punching blocks 36. The pieces of paper punched out are pushed through the guide holes 9 to drop into the waste storage chamber 4 for storage therein.

At the moment when the front ends of the two operation arms 40 start to be rotated downward by the operation pins 30 at their eccentric positions, one of the operation pins 30 starts from a position in the guide concavity 44 formed at the upper-front portion of the guide groove 43 of one of the operation arms 40. The other operation pin 30 starts from a position somewhere between the middle and the rear portion of the guide groove 43 of the other operation arm 40. Therefore, although the two punching blocks 36 simultaneously start to be lowered by means of the two operation arms 40, their punching blades 37 approach the paper A not simultaneously, but with a staggered timing. Consequently the peak consumption of electricity is reduced by about half compared with an apparatus which calls for simultaneous punching of two filing holes. Further, since the starting position of the operation pin 30 in the guide concavity 44 starts at a higher position, the downward stroke of thus punching block 36 is greater by the offset of the guide concavity 44 than the downward stroke of the other punching block 36.

As the rotary shaft 24 continues to rotate, the two operation pins 30 attached to the rotary disks 29 begin raising the front ends of the operation arms 40 about their supporting shaft 39 as the center of revolution. The punching blocks 36, having punched filing holes at the punching areas in the paper A, are moved upward along the guide bores 34 so that the punching blades 37 thereof are raised out of the punching holes 35 and returned to their respective specified positions above the insertion concavity 33 and inside the guide bores 34, thus becoming ready for the next punching operation.

At this point in the operation, the upward movement of one of the punching blocks 36 is reinforced by the restoring force of the spring 45 thereupon which has been compressed during the punching operation. The operation arm 40 provided therewith is thereby raised a large distance into the guide concavity 44 which again catches the operation pin 30 in its upper notch.

Simultaneously with the two punching blocks 36 being raised and returned to their starting positions, the pushing section 54 of the cam 53 of the rotary shaft 24, rotates out of contact with the switching piece 52 of the second switch 51. The releasing section 55 is moved into position immediately below the switching piece 52 of the second switch 51. This releases switching piece 52 of the second switch 51 whereby the second switch 51 is turned off. The control circuit 23 on the printed circuit board 22 is deenergized, and the motor 20 stops running.

If punching of sheets of paper A by the two punching blocks 36 cannot be completed due to the thickness or condition of the paper A or the thickness of the stack of paper A one, or both, of the punching blocks 36 may become stuck in the paper A either during the upward or downward parts of their strokes.

The revolution of both operation arms 40 is stopped by the punching blocks 36. Rotation of the rotary shaft 24 is halted by the brake-action of the operation arms 40 via the operation pins 30 thereof. The cam 53 stops rotating during the rotating movement of the pushing section 54 of the cam 53. This occurs while the switching piece 52 of the second switch 51 is completely closed and, as a result, the motor 20 stalls.

Simultaneously closing the third and fourth switches, while the second switch is also closed drives the motor 20 in the reverse direction to free the punching blocks 36 from the paper A.

Pushing the operating section 64 of the operation lever 62 inward into the guide opening 65, the operation lever 62 moves the pushing section 63 of inward into contact with the switching pieces 58 and 59 of the third and fourth switches 56 and 57. The switching pieces 58 and 59 simultaneously being completely closed, the third and fourth switches 56 and 57 are turned on, the control circuit 23 on the printed circuit board 22 is switched into a condition for driving the motor 20 in the reverse direction. With reverse rotation of the power gear 27 of the motor 20, the rotary shaft 24 is interlockingly rotated in the reverse direction via the gearing mechanism 26 and the reverse rotation of the drive gear 25. Consequently, the operation pins 30 on both rotary disks 29 are revolved in the reverse direction so that the two punching blocks 36 are forced, by the two operation arms 40, to pull out of the paper A.

The cam 53 is rotated in the reverse direction by the reverse rotation of the rotary shaft 24, and the pushing section 54 of the cam 53 is rotated in the reverse direction as long as the switching piece 52 of the second switch 51 is completely closed. When the two punching blocks return to their starting positions, the releasing section 55 of the cam 53 is rotated into contact with the switching piece 52. The switching piece 52 is opened by the releasing section 55, thus turning off the second switch 51.

Reverse drive of the motor 20 is stopped by of the circuit control 23 on the printed circuit board 22. The motor 20 is returned to the ready state for forward drive. It is thus possible to release both the punching blocks 36 and the paper A from any possible accident or jamming without damage to either.

Figure 5:
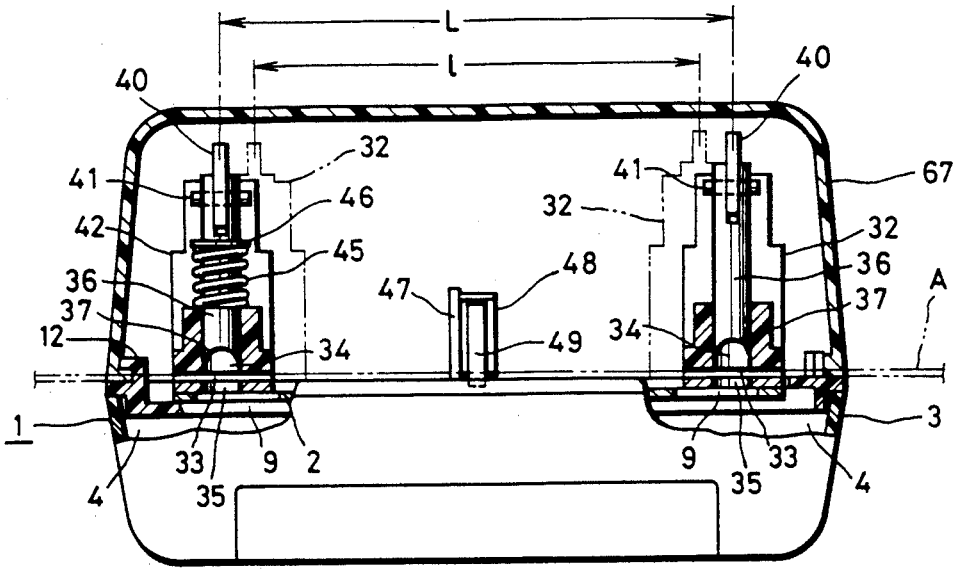
FIG. 5 is a cross section taken along the line d—d of FIG. 1.
Figure 6:
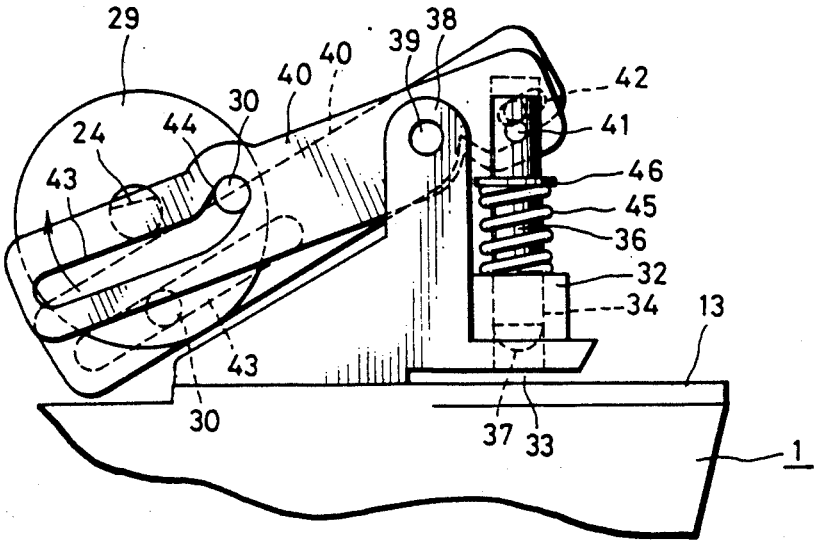
FIG. 6 is a side view of a punching block of FIG. 1.

The two punching blocks 36 can be installed with either one of two spacings between them. A distance L of 80 mm, between the punching blocks 36 is selected, as shown in FIG. 1, by fitting the spacers 28 over ends of the rotary shaft 24 and fix the rotary disks 29 provided with the operation arms 40 on the rotary shaft 24 outside the spacers. The holders 32, each of which supports one of the two operation arms 40 are secured in the outermost fitting holes **33*a* by screws to set the distance L between the punching blocks 36 at 80 mm as shown in FIG. 5**.

To set the distance l between the punching blocks 36 at, for example, 70 mm, the spacers 28 are omitted and the rotary disks 29 are installed directly on both ends of the rotary shaft 24. In the same manner as the above, the holders 32, are adjusted in accordance with their respective positions of the operation pins 30 of the rotary disks 29, on the left and right parts of the base plate 2. The holders 32 are secured using the innermost fitting holes **32*a*. Thus, the distance l between the punching blocks 36 can be easily set at 70 mm as shown in FIG. 5**.

Smooth vertical movement of each punching block 36 can be attained by adjusting the lateral position of the respective holders within the limit of the lateral length of each guide hole 9, which is a sidewise elongated circle. Further, the holders 32 are fixed by selecting the fitting holes **32*a* of the correct positions among a plurality of fitting holes 32*a* on the base plate 2 and fastening the holders 32 thereat with a plurality of screws 32*b***.

According to the present invention, a guide groove 43 is formed in the rear portion of each operation arm 40 revolvably supported by their respective holders; a guide concavity 44 is formed at the upper end of one of these guide grooves 43; a pair of operation pins 30 are revolvably inserted in the guide concavity 44 and in the other guide groove 43 respectively at an eccentric and off-line position with each other; one of the operation arms 40 is provided with restoring force by means of a coil spring 45; and it is thereby ensured that the two punching blocks 36 can be raised and lowered in a staggered timing with a large stroke so that filing holes will be bored smoothly and thoroughly through sheets of paper and that the paper will be released after punching out the filing holes without being damaged by the punching blades 37. Further, the present invention makes it possible to attain a large stroke of the punching blocks 36 with a simple construction, because the guide concavity 44 is formed at the upper end of the guide groove 43 of one of the operation arms 40 as a part of the guide groove 43, with the operation arm 40 provided with restoring force in order for one of the operation pins 30 to be caught in the guide concavity 44. A waste storage chamber 4 is established under the punching holes 35, wherein waste pieces of paper punched out are all caught without being scattered out of the apparatus. Thus, according to the present invention it is possible to provide a portable electric punch of high utility and productivity.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electric punch comprising;

a base plate;

at least first and second punching holes associated with said base plate;

at least first and second punching blocks;

means for guiding said at least first and second punching blocks vertically into said first and second punching holes;

a first operation arm;

first means for rotatably connecting said first operation arm to said first punching block;

a first supporting shaft hingeably supporting said first operation arm;

a first guide groove in said first operation arm;

a first operation pin engaging said first guide groove;

first rotary means for driving said first operation pin about an axis, whereby said first operation arm is rotated about said first supporting shaft, and said first punching block is moved in a vertical direction with regard to said first punching hole;

a second operation arm;

second means for rotatably connecting said second operation arm to said second punching block;

a second supporting shaft hingeably supporting said second operation arm;

a second guide groove in said second operation arm;

a second operation pin engaging said second guide groove;

second rotary means for driving said second operation pin about an axis, whereby said second operation arm is rotated about said second supporting shaft, and said second punching block is moved in a vertical direction with respect to said second punching hole;

means for concertedly driving said first and second rotary means for driving;

said means for concertedly driving including means for disposing said first and second operation pins at rotational positions that are mutually asymmetrical; and means for producing a second length stroke of said second punching block that is different from a first length of stroke of said first punching block, whereby said first and second length strokes are completed at staggered times.

2. An electric punch according to claim 1, wherein said second length of stroke is greater than said first length of stroke.

3. An electric punch comprising:

a base plate;

at least first and second punching holes associated with said base plate;

at least first and second punching blocks;

means for guiding said at least first and second punching blocks vertically into said first and second punching holes;

a first operation arm;

first means for rotatably connecting said first operation arm to said first punching block;

a first supporting shaft hingeably supporting said first operation arm;

a first guide groove in said first operation arm;

a first operation pin engaging said first guide groove;

first rotary means for driving said first operation pin about an axis, whereby said first operation arm is rotated about said first supporting shaft, and said first punching block is moved in a vertical direction with respect to said first punching hole;

a second operation arm;

second means for rotatably connecting said second operation arm to said second punching block;

a second supporting shaft hingeably supporting said second operation arm;

a second guide groove in said second operation arm;

a second operation pin engaging said second guide groove;

second rotary means for driving said second operation pin about an axis, whereby said second operation arm is rotated about said second supporting shaft, and said second punching block is moved in a vertical direction with respect to said punching hole;

means for concertedly driving said first and second rotary means for driving;

said means for concertedly driving including means for disposing said first and second operation pins at rotational positions that are mutually asymmetrical;

means for producing a second length stroke of said second punching block that is different from a first length of stroke of said first punching block, whereby said first and second length strokes are completed at staggered times;

said second guide groove includes a guide concavity; said guide concavity being disposed at a position along said second guide groove coinciding with a position of said second operation pin during a quiescent condition of said electric punch; and said guide concavity being effective for producing said second length of stroke.

4. An electric punch comprising:

a base plate;

at least first and second punching holes associated with said base plate;

at least first and second punching blocks;

means for guiding said at least first and second punching blocks vertically into said first and second punching holes;

a first operation arm;

first means for rotatably connecting said first operation arm to said first punching block;

a first supporting shaft hingeably supporting said first operation arm;

a first guide groove in said first operation arm;

a first operation pin engaging said first guide groove;

first rotary means for driving said first operation pin about an axis, whereby said first operation arm is rotated about said first supporting shaft, and said first punching block is moved in a vertical direction with respect to said first punching hole;

a second operation arm;

second means for rotatably connecting said second operation arm to said second punching block;

a second supporting shaft hingeably supporting said second operation arm;

a second guide groove in said second operation arm;

a second operation pin engaging said second guide groove;

second rotary means for driving said second operation pin about an axis, whereby said second operation arm is rotated about said second supporting shaft, and said second punching block is moved in a vertical direction with respect to said second punching hole;

means for concertedly driving said first and second rotary means for driving;

said means for concertedly driving including means for disposing said first and second operation pins at rotational positions that are mutually asymmetrical;

means for producing a second length stroke of said second punching block that is different from a first length of stroke of said first punching block, whereby said first and second length strokes are completed at staggered times;

a guide concavity in said second guide groove;

said guide concavity being disposed at a position along said second guide groove coinciding with a position of said second operation pin during a quiescent condition of said electric punch, said guide concavity being effective for producing said second length of stroke of said second punching block; and resilient means for urging said second guide block in a direction tending to move said second operation pin into said guide concavity.

5. An electric punch according to claim 4, wherein said resilient means is effective for providing a restoring force effective for urging said second punching block away from a material being punched, and for urging said operating pin into said guide concavity during a quiescent condition of said electric punch.

6. An electric punch comprising:

at least first and second punching holes;

at least first and second punching blocks aligned for linear movement into and out of said first and second punching holes, respectively;

means for concertedly driving said first and second punching blocks into said first and second punching holes, whereby holes are punched in a material;

said means for concertedly driving including rotating means effective for executing a circle of motion during one cycle of operation of said first and second punching blocks;

means for initiating said cycle upon an insertion of said material into said punch;

means for continuing said cycle until its completion;

means for reversing a direction of said driving in the event that said paper punch becomes stalled within said cycle; and means for stopping said reversing at a point in said circle of motion that permits normal forward driving to be performed in response to insertion of a material.

7. An electric punch comprising:

first and second punching blocks;

first and second punching holes aligned with said first and second punching blocks;

at least one rotary drive element;

a first operation arm;

means for connecting said first operation arm to said first punching block for generally linear displacement of said first punching block;

a first guide groove in said first operation arm;

first engaging means for engaging said at least one rotary drive element with said first guide groove;

a second operation arm;

a second guide groove in said second operation arm;

second engaging means for engaging said at least one rotary drive element with said second guide groove;

said first and second engaging means including means for performing a rotation during a cycle of said electric punch;

said at least one rotary drive element including means for providing asymmetrical rotational positioning of said first and second engaging means; and means for producing a longer operating stroke in said first punching block than in said second punching block.

8. An electric punch comprising:

first and second punching blocks;

first and second punching holes aligned with said first and second punching blocks;

at least one rotary drive element;

a first operation arm;

means for connecting said first operation arm to said first punching block for generally linear displacement of said first punching block;

a first guide groove in said first operation arm;

first engaging means for engaging said at least one rotary drive element with said first guide groove;

a second operation arm;

a second guide groove in said second operation arm;

second engaging means for engaging said at least one rotary drive element with said second guide groove;

said first and second engaging means including means for performing a rotation during a cycle of said electric punch;

said at least one rotary drive element including means for providing asymmetrical rotational positioning of said first and second engaging means;

means for producing a longer operating stroke in said first punching block than in said second punching block;

said means for producing a longer operating stroke including:

a guide concavity in said second guide groove;

said guide concavity being located at a position in said second guide groove adjacent said second engaging means when said electric punch is in a quiescent condition; and resilient means for urging engagement between said guide concavity and said second engaging means.

* * * * *